US006389846B1

(12) United States Patent
Siebenberg

(10) Patent No.: US 6,389,846 B1
(45) Date of Patent: May 21, 2002

(54) PRONG SETTING FOR MULTIPLE GEMSTONES

(75) Inventor: Benjamin Siebenberg, White Plains, NY (US)

(73) Assignee: Am-Gold Products, Inc., New York, NY (US)

( * ) Notice: Subject to any disclaimer, the term of this patent is extended or adjusted under 35 U.S.C. 154(b) by 0 days.

(21) Appl. No.: 09/522,984

(22) Filed: Mar. 10, 2000

(51) Int. Cl.[7] ..... A44C 17/00

(52) U.S. Cl. ..... 63/26; 63/27; 63/28; D11/91; D11/92

(58) Field of Search ..... 63/26, 27, 28; D11/91, 92

(56) References Cited

U.S. PATENT DOCUMENTS

| | | | | | |
|---|---|---|---|---|---|
| 256,063 | A | * | 4/1882 | Smith | 63/27 |
| 1,204,916 | A | * | 11/1916 | Whitehouse | 63/28 |
| 2,200,841 | A | * | 5/1940 | Gaertner | 63/27 |
| D143,988 | S | * | 2/1946 | Pennino | D11/86 |
| D172,922 | S | * | 8/1954 | Colmar | D11/92 |
| 3,394,692 | A | * | 7/1968 | Sirakian | 125/30.01 |
| D232,653 | S | * | 9/1974 | Hess | D11/92 |
| D265,641 | S | * | 8/1982 | Bongiorno | D11/92 |
| D410,407 | S | * | 6/1999 | Tirakian | D11/92 |
| D422,935 | S | * | 4/2000 | Chan | D11/92 |
| D434,693 | S | * | 12/2000 | Kaplan | D11/91 |

* cited by examiner

*Primary Examiner*—B. Dayoan
*Assistant Examiner*—Andrea Chop
(74) *Attorney, Agent, or Firm*—Levisohn, Lerner, Berger & Langsam, LLP

(57) ABSTRACT

A unitary prong setting for multiple gemstones and a multiple gemstone combination are provided. The setting includes a first set of prongs, each of which contacts and is adapted to fold over ends of two adjacent gemstones. The first set of prongs press the gemstones together and thereby securing the gemstones to the setting. Each of the first set of prongs is interconnected by a set of respective bars connecting each of the first prongs to a point substantially central to the first prongs; the first set of prongs presses the gemstones together and against the set of bars. The invention preferably further includes a second set of prongs projecting from the main base. The second set of prongs are adapted not to fold over the gemstones. The secondary prongs may provide ancillary support to the gemstones from underneath, or they may merely be decorative.

13 Claims, 3 Drawing Sheets

PRONG SETTING FOR MULTIPLE GEMSTONES

BACKGROUND OF THE INVENTION

1. Field of the Invention

The invention relates to a setting for jewelry, and more particularly it relates to a setting for multiple gemstones.

2. Description of the Related Art

Jewelry including diamonds and gemstones are widely known. Because precious and semi-precious gemstones are expensive—typically, the larger the stone, the more expensive the stone—, it is also known to use several smaller stones fitted together to resemble one large stone.

The traditional setting for fitting together several small stones to resemble one large stone is a cup- or bowl-shaped setting. The cup shape provides a great deal of security in preventing the stones from coming loose or falling out.

However, there are drawbacks to the traditional cup setting. First, the stones sit in the cup up to (or nearly up to) their girdles. Because the cup setting is made from metal, it is opaque and does not allow light to enter the stones from the bottom or the sides. As a result, stones held in such a setting will not sparkle as much as if they were in separate prong settings, owing to the reduced amount of light that can enter the stone and be reflected internally. Also, conventional stones in a prong setting appear larger than they really are, owing to the optical illusion created by the stone's brilliance and the prongs themselves. Generally, the prongs visually interact with scintillations near the edges of the stones to make the stones appear that they are as wide in diameter as the prongs. However, this effect is lost on cup-set multiple stones; because the setting is opaque metal, the stones are given a very clear and distinct boundary by the cup and thus cannot exhibit the illusion of appearing bigger than they actually are. Moreover, the cup setting hides the bulk of the stone below the table, thus creating the appearance that the stones are not very large. Prong settings have thus far been impractical for use with multiple stones because there is insufficient security imparted to the stones, i.e., they can easily fall out of the setting.

SUMMARY OF THE INVENTION

Accordingly, it is an object of the invention to provide a setting for multiple gemstones that allows greater amounts of light to enter the stones.

It is another object of the invention to provide a setting for multiple gemstones that displays a greater amount of the stones themselves.

It is another object of the invention to provide a setting for multiple gemstones that enable the stones to appear bigger than they actually are.

It is another object of the invention to provide a setting for multiple gemstones that securely hold the stones together in the setting.

The above and other objects are fulfilled by the invention, which is a unitary setting for multiple gemstones. That is, the setting can be made as a single piece of metal from a single casting. The setting includes a first set of prongs emanating from a central focal point. Each of the first prongs contacts and is adapted to fold or be bent over ends of two adjacent gemstones. The first set of prongs press the gemstones together and thereby securing the gemstones to the setting. Each of the first set of prongs is interconnected by a set of respective bars connecting each of the first prongs to another point substantially central to the first prongs above the first focal point from which all the prongs emanate. The first set of prongs presses the gemstones together and against the set of bars.

The invention preferably further includes a second set of prongs projecting from the same central focal point as the first prongs. Second prongs may extend as high as the first set of prongs, or they may extend to a lesser extent than the first set of prongs. The second set of prongs are not folded over the gemstones. The second prongs may ancillarily support the gemstones under the girdles of the gemstones, or they may be merely decorative. Both the first and second sets of prongs are disposed substantially equidistantly around the setting. Preferably, the second prongs are disposed substantially equidistantly around the setting and are interleaved among the first set of prongs in an alternating pattern. The inventive setting is particularly adapted to support three gemstones, preferably pie-cut or marquis-cut gemstones.

The invention also includes a combination of pie-cut or marquis-cut gemstones and the inventive prong setting described above.

DETAILED DESCRIPTION OF THE PREFERRED EMBODIMENTS

Description will now be given of the preferred embodiments with reference to FIGS. 1–4. The figures are only illustrative and do not constitute limitations on the scope of the invention, which is defined by the claims attached hereto.

Figure 1:
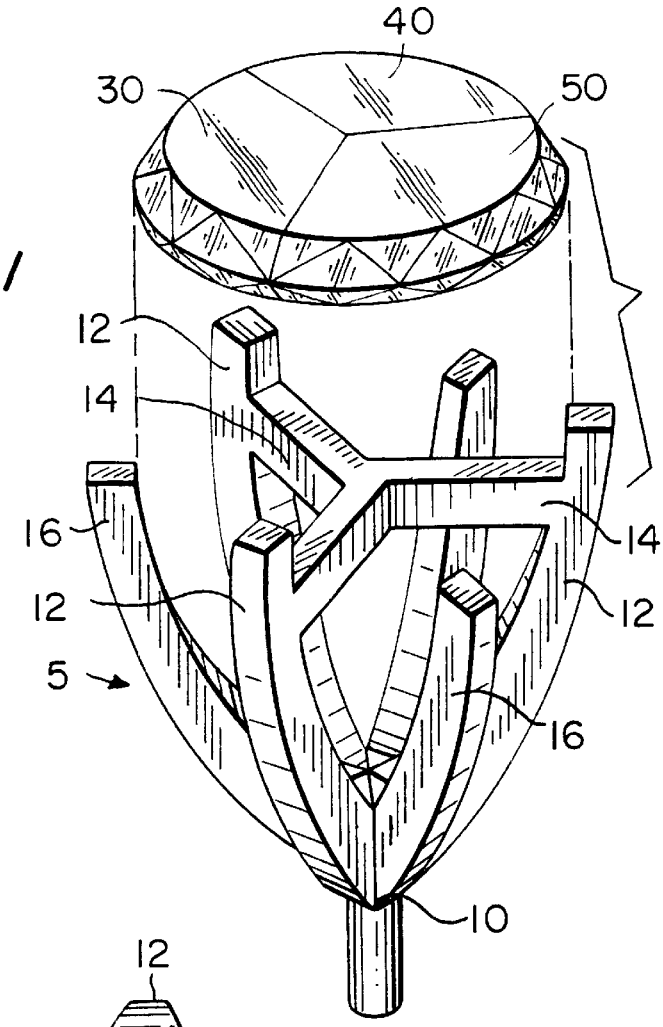
FIG. 1 is a perspective view of the inventive setting showing three gemstones in exploded perspective.
Figure 2:
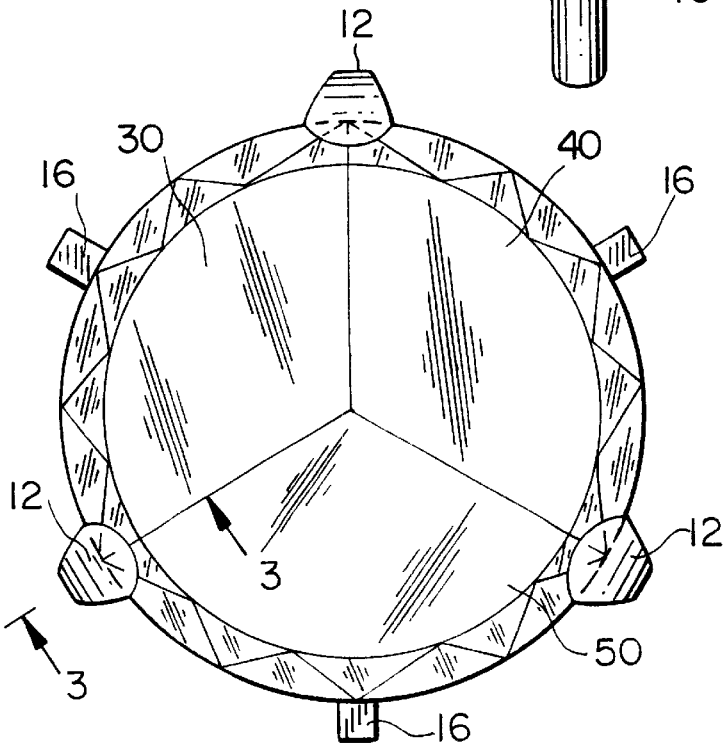
FIG. 2 is a top elevation view of the inventive setting supporting three gemstones.
Figure 3:
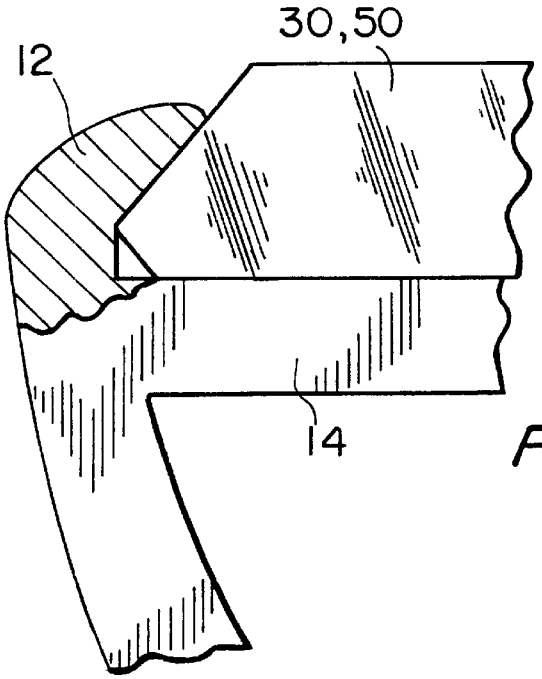
FIG. 3 is a partial sectional view taken along line 3—3 in FIG. 2.
Figure 4:
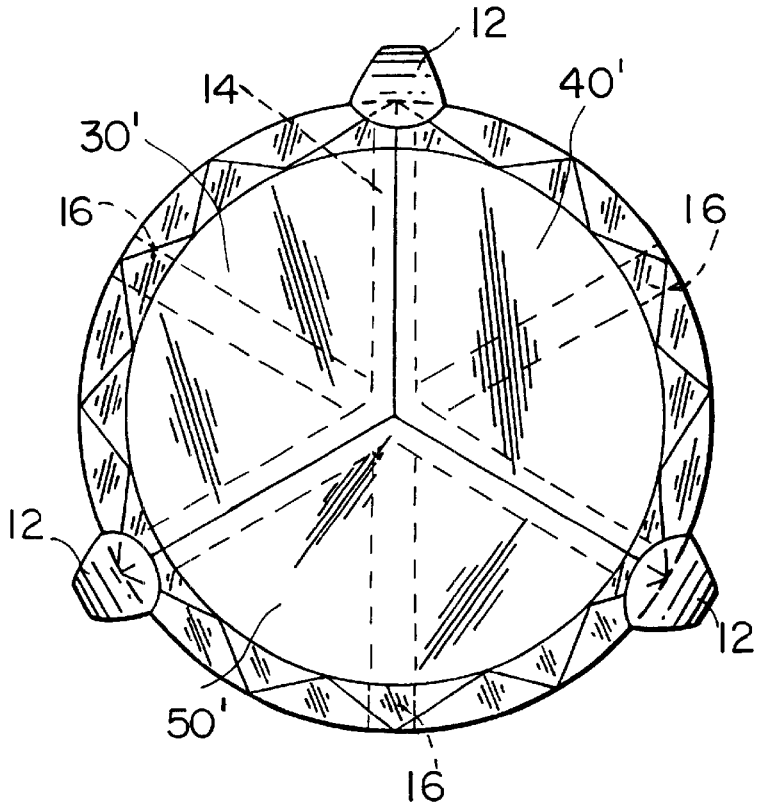
FIG. 4 is a top view of an alternate embodiment of the inventive setting.

As shown in FIG. 1, the inventive setting 5 is a prong setting with a number of prongs 12, 16 emanating from a main base 10. Primary prongs 12 are interconnected in a central location by bars 14. Each prong 12 includes a bar 14 which connects to the other two bars 14 in the center of the setting. It is these primary prongs 12 and bars 14 which secure the gemstones 30, 40, and 50 in place. As shown in FIGS. 2–4, the tops of prongs 12 are adapted to extend higher than the girdles of stones 30–50. When stones 30–50 are placed in setting 5, the tops of prongs 12 are bent or folded over the girdles of the stones. The stones are secured at their ends by prongs 12 and preferably on their undersides by bars 14. Each prong 12 is adapted to secure the comers of two adjacent stones when the top of the prong is bent over the girdles of the stones.

Setting 5 is particularly well-suited for retaining and displaying three marquis-cut gemstones together, as shown in FIG. 2. Pie-cut gemstones have boundaries which fit together to give the appearance of a single round stone as shown in the Figures. However, the invention can be used for any number of stones in any number of different cuts. It is preferred that the number of primary prongs 12 match the number of stones being set.

In addition to primary prongs 12, the inventive setting 5 may also include a second set of secondary prongs 16. Prongs 16 also emanate from central focal point 10. Prongs 16 are preferably interleaved with primary prongs 12 to form an alternating pattern around the setting of primary-secondary-primary-secondary prongs. Secondary prongs 16 may provide ancillary support to the undersides of stones 30–50, or they may merely be decorative. Secondary prongs 16 may be as long as primary prongs 12, as shown in FIGS. 1 and 2, or they may be shorter than primary prongs 12 and not extend as high above central focal point 10 as do primary prongs 12, as shown in FIG. 4. In either case, the tops of secondary prongs 16 are not folded or bent over the girdles of the stones as do the tops of primary prongs 12. As shown in FIG. 2, prongs 16 extend just up to the girdles of stones 30–50 so that prongs 16 are visible from above but do not fold over the stones. As shown in FIG. 4, prongs 16 may be shorter than prongs 12 and will not extend up to the girdles of the stones. Thus, they are shown in dotted lines in FIG. 4 as being invisible from a top view. Alternatively, the secondary prongs 16 of FIG. 4 may be the same length as those of FIG. 1 and 2 but merely bent inwardly underneath the girdles of the stones.

Figure 5:
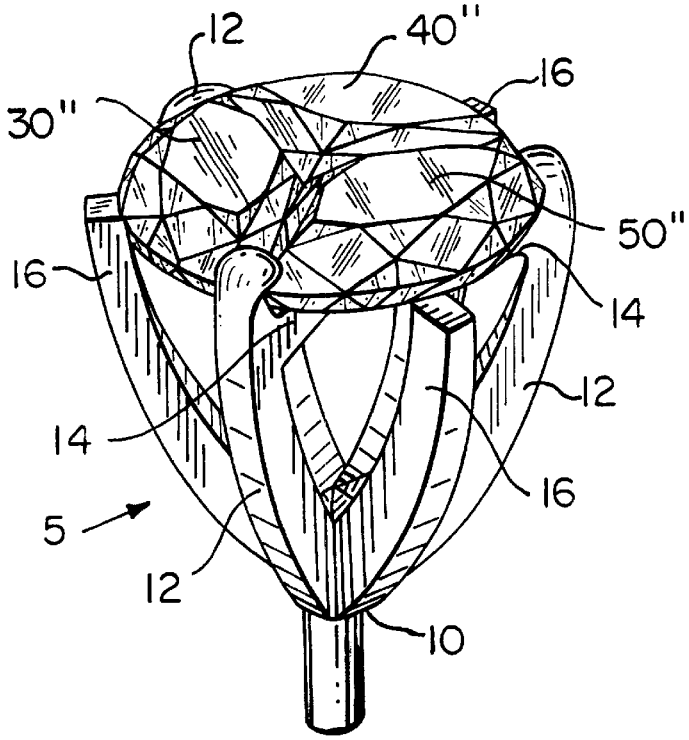
FIG. 5 is a perspective view of the inventive setting showing three marquis-style gemstones in exploded perspective.
Figure 6:
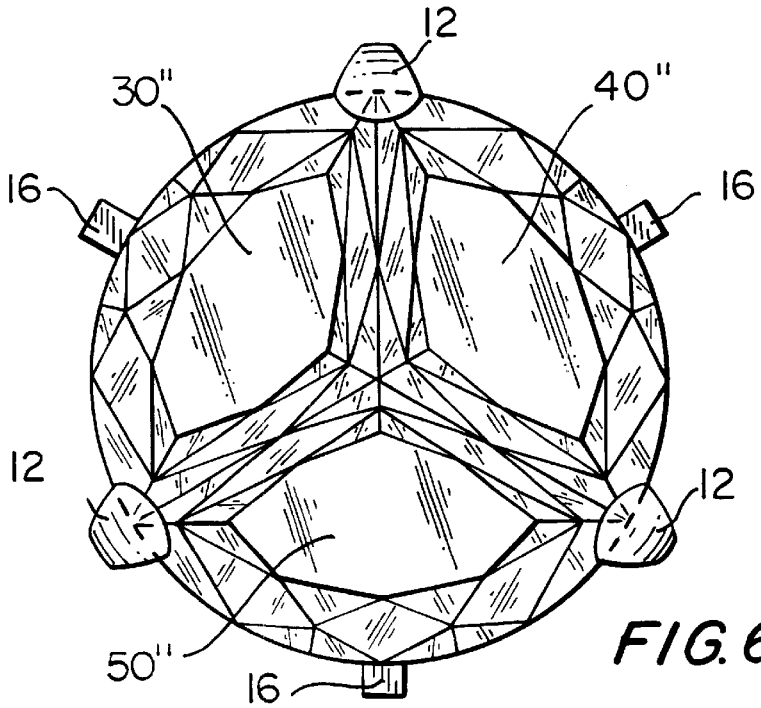
FIG. 6 is a top elevation view of the inventive setting supporting the three gemstones of FIG. 5.

The stones intended to be used with the invention may be of different sizes, shapes, and positional configurations as well. For example, in FIG. 2, the stones all meet in the center and none of the bars 14 are visible. However, as shown in FIG. 4, stones 30', 40', and 50' are of a different size or shape, or they are positioned slightly differently than those of FIG. 2, so that bars 14 are visible from the top. Similarly, marquis-style gemstones 30", 40", and 50" are shown in FIGS. 5 and 6. Lower facets of the stones meet, although as shown in FIG. 5, the three stones do not actually meet at their upper surfaces.

The inventive setting 5 allows light to enter the stones from the sides and from the bottom, thereby causing more light to reflect internally and thus increasing the brilliance of the stones. The setting 5 also provides all of the visual benefits of a prong setting, vis-a-vis providing the illusion of a larger stone. Moreover, the setting may be constructed from a single piece of metal from a single casting, thus reducing manufacturing and labor costs. Also, the inventive setting positions the smaller stones (preferably either pie-cut marquis-cut stones) so as to form the appearance of a single round stone by not creating any spaces or gaps between the individual smaller stones.

The invention is not limited to the above description but rather is defined by the claims appearing hereinbelow. Modifications to the above description that include that which is known in the art are well within the scope of the contemplated invention. For example, any number of prongs may be implemented in the invention to retain any number of stones. Preferably, however, the primary prongs secure the stones at their corners, so that the number of prongs should equal the number of stones to be set. Similarly, any number of secondary prongs may be used with the invention. Of course, the setting may be made from any material known to the jewelry arts, for example, gold, platinum, silver, etc., and the stones may be made from any precious or semi-precious (or non-precious) material.

What is claimed is:

1. In combination, a unitary setting and multiple gemstones to form the appearance of a single round stone from said multiple gemstones, said gemstones being adjacent to each other, said setting comprising:

a first set of prongs emanating upwardly from a first central focal point, wherein each of said first set of prongs contacts and is adapted to be bent over ends of said adjacent gemstones of said multiple gemstones, said first set of prongs pressing the gemstones together, the spacing of said prongs from each other being sized in relation to the gemstones held thereby to press the gemstones set by said prongs together thereby securing the gemstones to said setting, said setting being round and positioning the gemstones to form the appearance of a single round stone, wherein said first set of prongs is connected by respective support bars connecting each of said first prongs to a second point substantially central to said first prongs and above said first central focal point, further comprising a second set of prongs projecting from said first central focal point and adapted not to fold over the gemstones.

2. A unitary setting for multiple gemstones according to claim 1, wherein said first set of prongs presses the gemstones together and against said support bars.

3. A unitary setting for multiple gemstones according to claim 1, wherein said second prongs ancillarily support the gemstones.

4. A unitary setting for multiple gemstones according to claim 3, wherein said second prongs are adapted to support the gemstones each in a central portion of each gemstone.

5. A unitary setting for multiple gemstones according to claim 1, wherein said first prongs are disposed substantially equidistantly around said setting.

6. A unitary setting for multiple gemstones according to claim 5, wherein said second prongs are disposed substantially equidistantly around said setting and interleaved among said first set of prongs in an alternating pattern.

7. A unitary setting for multiple gemstones according to claim 5, wherein each of said first and second sets of prongs are three in number, said setting adapted to support three gemstones.

8. A unitary setting for multiple gemstones according to claim 1, wherein said setting is adapted to support at least one of pie-cut and marquis-cut gemstones.

9. A unitary setting for multiple gemstones according to claim 1, wherein the number of said first prongs is equal to the number of gemstones to be supported by said setting.

10. A unitary setting for multiple gemstones according to claim 1, wherein the number of said second prongs is equal to the number of gemstones to be supported by said setting.

11. A multiple gemstone combination, comprising:

a plurality of gemstones, each of said gemstones having at least two straight sides, said gemstones being fittable together to form a single round configuration; and a setting including a first set of prongs emanating from a first central focal point, wherein each of said first set of prongs contacts and is adapted to be bent over ends of two adjacent of said gemstones, said first set of prongs pressing said gemstones together and thereby securing said gemstones to said setting, the spacing of said prongs from each other being sized in relation to the gemstones held thereby to press the gemstones set by said prongs together, said setting being round and positioning said gemstones to form the appearance of a single round stone, wherein each of said first set of prongs is interconnected by a set of respective bars connecting each of said first prongs to a second point substantially central to said first prongs above said first central focal point.

12. A multiple gemstone combination according to claim 11, further comprising a second set of prongs projecting from said first central focal point and adapted not to fold over the gemstones.

13. A multiple gemstone combination according to claim 12, wherein said first prongs are disposed substantially equidistantly around said setting and wherein said second prongs are disposed substantially equidistantly around said setting and interleaved among said first set of prongs in an alternating pattern.

* * * * *